United States Patent [19]

Eastwood

[11] Patent Number: 4,567,986

[45] Date of Patent: Feb. 4, 1986

[54] UNIT PORTION PACK

[75] Inventor: Michael C. Eastwood, Oxford, England

[73] Assignee: Metal Box plc, Reading, England

[21] Appl. No.: 618,396

[22] PCT Filed: Oct. 14, 1983

[86] PCT No.: PCT/GB83/00262

§ 371 Date: Jun. 5, 1984

§ 102(e) Date: Jun. 5, 1984

[87] PCT Pub. No.: WO84/01556

PCT Pub. Date: Apr. 26, 1984

[30] Foreign Application Priority Data

Oct. 14, 1982 [GB] United Kingdom ..... 8229402

[51] Int. Cl.[4] ..... B65D 3/26; B65D 17/28

[52] U.S. Cl. ..... 206/532; 206/531; 206/539; 206/484; 206/634; 206/820

[58] Field of Search ..... 206/531, 532, 538, 539, 206/484, 484.2, 634, 820

[56] References Cited

U.S. PATENT DOCUMENTS

| | | | |
|---|---|---|---|
| 1232033 | 10/1960 | FRX . | |
| 2,386,416 | 10/1945 | Wilhelm | 206/539 |
| 2,461,660 | 2/1949 | Salfisberg | 206/820 |
| 2,791,324 | 5/1957 | Knoop et al. . | |
| 3,036,700 | 5/1962 | Krug | 206/365 |
| 3,053,385 | 9/1962 | Spees | 206/438 |
| 3,216,562 | 11/1965 | Lockwood | 206/532 |
| 3,306,292 | 2/1967 | Spees | 206/634 |
| 3,759,371 | 9/1973 | Marks | 206/531 |
| 3,948,394 | 4/1976 | Hellstrom | 206/531 |
| 4,089,415 | 5/1978 | Laib | 206/532 |
| 4,169,531 | 10/1979 | Wood | 206/531 |
| 4,398,635 | 8/1983 | Hirt | 206/532 |

FOREIGN PATENT DOCUMENTS

| | | |
|---|---|---|
| 822546 | 12/1937 | France . |
| 943561 | 3/1949 | France . |
| 985972 | 7/1951 | France . |
| 2044725 | 2/1971 | France . |
| 2227190 | 11/1974 | France . |
| 2263945 | 10/1975 | France . |
| 6710571 | 2/1969 | Netherlands . |
| 2034662 | 6/1980 | United Kingdom . |

*Primary Examiner*—William T. Dixson, Jr.
*Assistant Examiner*—Brenda J. Ehrhardt
*Attorney, Agent, or Firm*—Burns, Doane, Swecker & Mathis

[57] ABSTRACT

A unit portion pack is made from two webs, at least one of which is a laminate (2) having layer (4) of tear resistant material, such as polyester film, and a layer (6) of rupturable material, such as aluminum foil. The two webs (2, 26) are bonded together by way of heat seals, (38, 40) to define a plurality of cavity-forming regions (34) in each of which a single pill (36) or other solid product item is received. A longitudinally extending score or slit line (10) extends along each longitudinally arranged row of regions (34) inwardly of the peripheries of the regions. The pill (36) is released by manipulating the pack such that the score or slitline is located on or outboard of the periphery of the pill by movement of the latter. The area of the cavity-forming region on the other side of the score or slit line to the pill is then squeezed to fracture the rupturable material at the score or slit line. This forms a dispensing opening through which the pill may be pushed. This forms a dispensing opening through which the pill may be pushed. The design of the pack and the position of the score or slit lines (10) can be chosen such that indiscriminate access to the contents of the package is not possible.

17 Claims, 8 Drawing Figures

UNIT PORTION PACK

The present invention relates to unit portion packs for pills, tablets, capsules or other solid product items.

The current form-fill-seal unit pack systems for various products, including pills, are generally strips or pouches made from metal foil, paper or tearable plastics films such that access to the contents is by tearing the pack. These packs can be opened very easily by children and therefore present a potential hazard to them.

It is an object of the present invention to provide a unit portion pack which although it does not allow indiscriminate access to its contents can still be opened relatively easily by an adult.

According to the present invention there is provided a unit portion pack for pills or like solid product items, the pack being formed of first and second webs defining therebetween a plurality of mutually spaced cavity-forming regions around the periphery of each of which the webs are bonded together, and a plurality of the said pills or like solid product items which are received in the cavity-forming regions individually and which are substantially smaller in at least one plan dimension than the corresponding plan dimension of the cavity-forming region, at least one of the webs being flexible whereby the product items may be manipulated to undergo movement within the cavity-forming regions at least in the direction of the said plan dimension, at least the first web being a laminate comprising a rupturable layer and a tear resistant layer which is formed with score or slit lines adapted to provide dispensing openings for the product items, the score or slit lines crossing the cavity-forming regions at a spacing from the peripheries of said regions but being located or locatable by a said movement of the product items within the cavity-forming regions to lie on or outboard of the peripheries of the product items.

Each product item is dispensed by rupturing the rupturable layer along the score or slit lines to provide a dispensing opening for that product item, and then by moving the product item through the dispensing opening so formed. The ease of difficulty of these steps can be chosen by the design of the pack.

The rupturable layer is arranged to be torn with assistance from or the cooperation of the product item. This may require locations of the product item relative to the appropriate score or slit line so that it can act as a tool and thereby provide assistance in the parting of the rupturable layer where required. If the product item is not correctly located in relation to the score or slit line it is difficult or impossible to form the dispensing opening.

In a preferred embodiment, each cavity-forming region and the product received therein are shaped and dimensioned such that adjacent area substantially triangular in cross section can be or is defined at the periphery of the cavity-forming region, said area being defined by spaced facing surfaces of said first and second webs and the periphery of said solid product item, and wherein the score or slit line is arranged to cross said area. In this arrangement the product item acts somewhat as a wedge to keep the facing surfaces of the two webs spaced. Thus, simply squeezing the two facing surfaces together will rupture the rupturable layer to form the dispensing opening.

Use of the product item in this manner enables the dispensing opening to be formed reliably and with a minimum of pressure. However, particularly the product item needs to be located in relation to the score or slit line before the dispensing opening can be formed, it is not a procedure which childred find easy to perform. Thus, it is thought that the present invention provides a good compromise between the conflicting requirements for a pack which is child resistant and is yet convenient to use.

The rupturable layer of the laminate material may be metal foil, such as aluminium foil, paper, or tearable plastics material film such as 25 uniaxially oriented low density polyethylene film.

The tear resistant material may be a plastics material film such as polyester, nylon or PVC film.

There are many possible designs for unit portion packs of the present invention.

For example, in one embodiment each of the first and second webs are heat sealed together by way of longitudinally extending and transversely extending heat seals defining one or more longitudinally aligned rows of the cavity-forming regions, the height of each cavity being the same as that of the product item contained having been extended by the product item, and wherein a respective score or slit line extends longitudinally of the pack across all the regions of one row, being located, adjacent to, but spaced inwardly of, a respective said longitudinally extending heat seal.

In an alternative embodiment, both said first and second webs have been formed from laminate to have a plurality of regularly spaced recesses therein, the recesses of the two webs being aligned and the two webs being bonded together around the recesses to define a plurality of cavity-forming regions, each cavity-forming region comprising a product item containing a central cavity surrounded by a peripheral unbonded region at which the webs are closely adjacent one another and wherein a score or slit line extends across each said cavity-forming region at the unbonded region thereof.

Embodiments of the present invention will hereinafter be described, by way of example, with reference to the accompanying drawings, in which.

Figure 1:
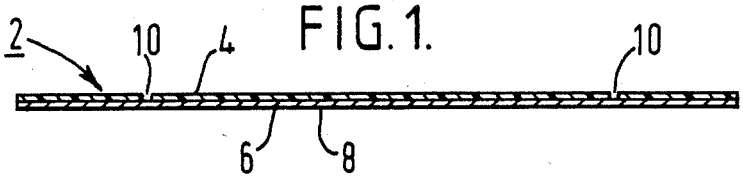
FIG. 1 shows a section through a web of a laminate material.
Figure 2:
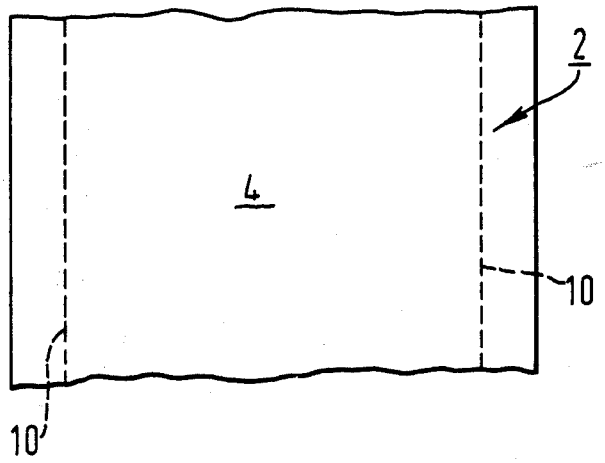
FIG. 2 shows a plan view of the web of FIG. 1.
Figure 3:
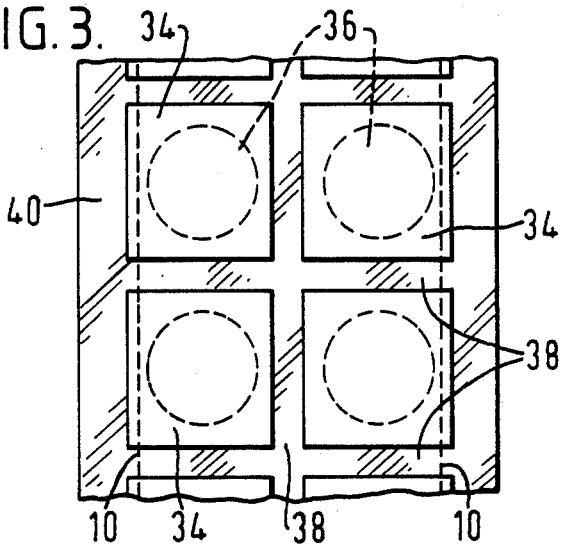
Figure 4:
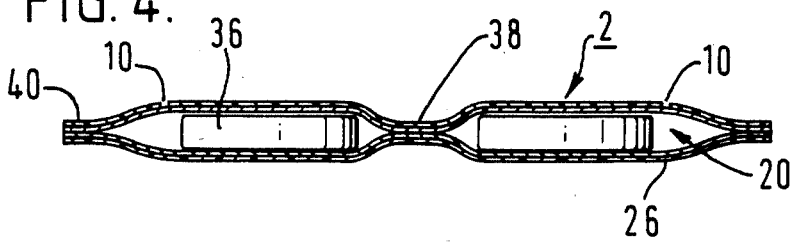
Figure 5:
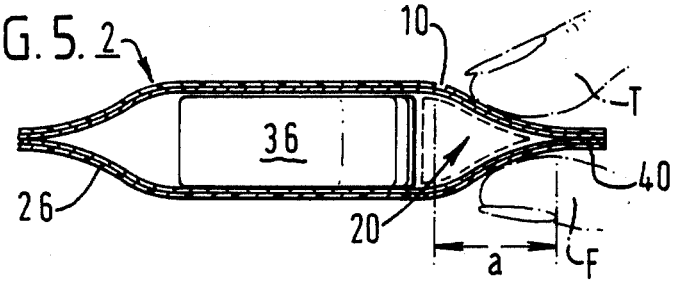
Figure 6:
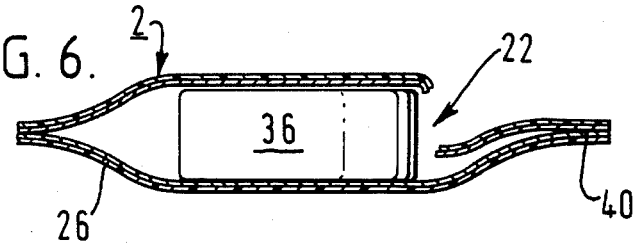
Figure 7:
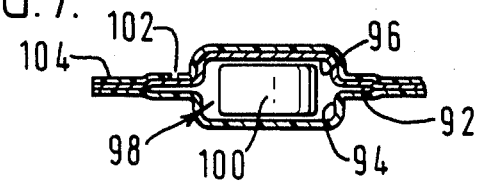
Figure 8:
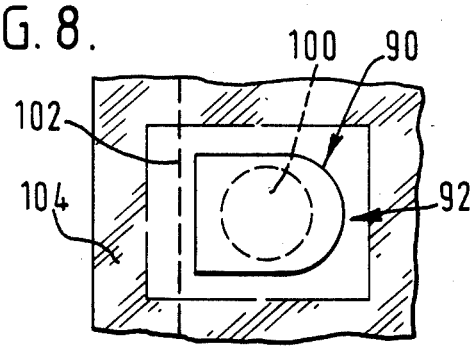

FIG. 3 shows a plan view of a first embodiment of a unit portion pack of the invention made from two webs of material, the top web being the web of FIGS. 1 and 2, FIG. 4 shows a transverse section through the pack of FIG. 3, FIG. 5 shows a partial transverse section of the pack of FIGS. 3 and 4 illustrating the opening of the pack, FIG. 6 shows a view similar to that of FIG. 5 after the formation of a dispensing opening, FIG. 7 shows a transverse section through a cavity-forming region of a second embodiment of a unit portion pack of the invention, and FIG. 8 shows a plan view of the cavity-forming region of FIG. 7.

FIGS. 1 and 2 show a section through and a plan view of a flexible web of a laminate material 2 which has a layer 4 of tear resistant material such as polyester film adhered to a layer 6 of rupturable material such as aluminum foil. The external surface 8 of the layer 6 is coated with a heat sealant.

Two transversely spaced slit lines 10 are formed to extend longitudinally of the web 2 in the tear resistant layer 4. In the embodiment illustrated, each slit line 10 is interrupted to thereby provide a row of perforations. Of course, if required, each of the slit lines 10 could be continuous. Alternatively, the slit lines 10 may be replaced by score lines which are either continuous or interrupted.

In the embodiment illustrated, the two longitudinally extending slit lines 10 each extend adjacent to and spaced about 1 cm inwardly of a longitudinal edge of the web 2.

FIG. 3 shows a plan view of one embodiment of a double strip pack made using the web 2 shown in FIGS. 1 and 2. The web 2 forms the top web of the pack and a second, bottom web 25 (FIG. 4) is heat sealed to it such that heat seals 38 and 40 define individual cavity-forming regions 34. The bottom web 26 can be of any suitable material capable of being heat sealed to the top web 2 and which preferably is also flexible.

In the embodiment illustrated in FIGS. 3 and 4, the cavity-forming regions 34 are defined to extend in two longitudinally aligned rows, one to each side of the pack. In this respect, a respective longitudinal heat seal 40 extends along each side edge of the pack, whilst transverse and longitudinal intermediate seals 38 separate the individual regions 34. A single solid product item 36, such as a pill, tablet or capsule, is received within each region 34 and is sealed therein.

The pack shown in FIGS. 3 and 4 is product extended. Thus, both of the webs 2 and 26 used in its formation are planar and can be drawn from a reel. During manufacture, the pills 36 are arranged in a regular pattern between the two webs 2 and 26. The heat seals 38 and 40 are then made to define the peripheries of the cavity-forming regions 34 so as together with the pills 36 to define the final shapes of the sealed cavities 34 in which the pills received.

It can clearly be seen from FIGS. 3 and 4 that the plan dimension of each tablet 36 transversely of the pack is substantially less than the corresponding plan dimension of each region 34. By virtue of the flexibility of the webs 2, 26 and of the pack as a whole, each pill can be manipulated to move transversely of the pack within the cavity-forming region 34 in which it is received.

As can be seen in FIGS. 3, each of the slit lines 10 of the top web 2 is arranged to extend substantially parallel to but transversely spaced from a respective longitudinal side edge of the pack inwardly of the respective longitudinal heat seal 40. Thus, each slit line 10 is arranged to cross all the cavity-forming regions 34 in one of the row. In other words, each region 34 is crossed by part of one of the slit lines 10.

The transverse dimension of each region 34 and the transverse spacing 'a' of the slit line 10 from the external periphery thereof are arranged relative to the transverse dimension of the tablet 36 such that the tablet can if necessary be located within the region 34 by manipulation of the pack until the slit line 10 is either aligned with or located outboard of its periphery. It will be appreciated that when the tablet is so arranged within the region 34, the peripheral edge of the tablet can be considered to define within the pack a vacant area 20 substantially triangular in cross-section whose other two sides are defined by spaced facing surfaces of the top and bottom webs 2 and 26.

FIGS. 5 and 6 show how the formation of this vacant area 20 enables the pack to be opened to dispense an individual tablet 36.

As can be seen in FIG. 5, the bottom side of the area 20 will normally be supported by one finger F of the user whilst the thumb T applies a force to the top side of the pack above the area, at the side of the slit line 10 remote from the pill 36. The force exerted by the thumb causes the frangible layer along the slit line and the remanent bridges of the slit line itself to be ruptured as shown in FIG. 6, such that a dispensing opening 22 is defined which extends longitudinally across the region 34. The pill 36 can then be pushed through the dispensing opening 22 by manipulating the pack to move the pill laterally out of the region 34.

It will thus be appreciated that dispensing of a pill 36 can be effected relatively simply by an adult. However, as it combines at least two and possibly three, different movements, namely a possible first manipulation of the pack to locate the pill in relation to the appropriate slit line 10, a pressure applying movement to rupture the pack along the slit line 10 and thereby form the dispensing opening 22, and lastly a manipulation of the pack to dispense the pill, it is difficult for a child to perform.

The embodiment shown in FIGS. 3 and 4 is a double strip pack including only two rows of sealed cavity-forming regions 34. Of course, the pack could be made to have a single row of regions 34 or more than two rows of such regions as required.

In the pack of FIGS. 3 and 4, additional perforations extending through both webs 2 and 26 could be provided to enable individual sealed regions 34 with their contents to be removed from the strip pack.

Examples of the flexible laminate material which may be used in packages of the invention are:

| Rupturable Layer | Tear Resistant Layer |
|---|---|
| 1. 20μ soft temper A foil | 20μ Melinex polyester film |
| 2. 9μ foil/paper laminate | 20μ Melinex polyester film |
| 3. 20μ soft temper A foil | 30μ cast nylon 6 film |
| 4. 25μ uniaxially oriented high density polyethylene film, draw ratio 8:1 | 20μ Melinex polyester film |
| 5. 25μ uniaxially oriented low density polyethylene film, draw ratio 8:1 | 100μ PVC sheet |

These laminates can be made on conventional machines and the layers thereof would generally be adhesively bonded. The material of the bottom web 26 of the pack could be made from the same laminate material or it could be made of any other suitable material capable of being heat sealed to the top web 2.

A further embodiment of the present invention is illustrated in FIGS. 7 and 8 which show a transverse section and a plan respectively of one cavity-forming region of a double formed blister pack. The double formed pack is made from thermoformed or cold formed top and bottom webs which are bonded together such that recesses in the top web are aligned with corresponding recesses in the bottom web whereby cavity-forming regions for the pills or other solid product items to be packaged are defined.

In one embodiment, one web, say the bottom web will be made of thermoformable thermoplastic material, such as PVC sheet, and will be formed to have a plurality of regularly spaced recesses as 94 therein. The top web will also be formed to have corresponding recesses as 96 therein such that the top and bottom webs when bonded at their contacting surfaces will define a plurality of cavity-forming regions 98 for receiving products such as pills 100. The top web will be formed from a thermoformable laminate material comprising a rupturable layer adhered to a tear resistant layer in which score or slit lines 102 extend. The score or slit lines may be either continuous or interrupted. One example of a thermoformable laminate comprises a frangible layer of 25μ uniaxially oriented low density polyethylene film and a tear resistant layer of 100μ PVC sheet. Either one or both of the webs should be flexible.

In the embodiment illustrated in FIGS. 7 and 8 the unformed areas of the two webs are bonded together in regions 104 spaced from and surrounding the cavity forming regions 98. It will be seen that each region 98 includes a central cavity 90 in which the pill 100 is normally received, surrounded by an unbonded region 92 at which the webs are normally closely adjacent one another. The score or slit line 102 is arranged to extend across the unbonded region 92 so as to be spaced inwardly of the periphery of the cavity-forming region 98 but outboard of the central cavity 90.

Because of the close adjacence of the top and bottom webs over the unbonded region 92, it is difficult or impossible to rupture the top web along the score or slit lines when the pills 100 are located in their central cavities 90.

In order to remove a pill 90 from the sealed region 98 in which it is received it is necessary to manipulate the pack to move the pill transversely towards the slit line 102. As it is moved, against resistance generated by the webs as they are being deformed, the pill will push and subsequently hold apart the two webs in the unbonded region 92. In this position, the peripheral edge of the pill can be considered to define adjacent area substantially triangular in cross-section together with the facing surfaces of the two webs in the unbonded region 92. The score or slot line 102 will extend in the top side of the triangular area on or outboard of the peripheral edge of the pill. Accordingly, as in the previous embodiment, the application of thumb pressure to the part of the top web on the opposite side of the score or slit line 102 to the pill 100 will rupture the frangible layer along the slit line 102. Thus, the pill acts as a wedge to define a vacant area of the pack such that external pressure applied to the pack above the vacant area can rupture the laminate at the score or slit line and thereby form a dispensing opening. Further manipulation of the pack will thereafter enable the pill to be removed from its cavity.

A blister pack in accordance with the invention may be made from two webs of the same laminate material, and may have either or both of the webs thermoformed or cold formed to define cavity-forming regions for the product items to be packaged. A laminate material comprising a layer of aluminium foil, a tear resistant and protective layer of plastics material such as nylon on the outside of the foil, and a heat sealable layer on the inside of the foil, may be cold formed for this purpose.

Of course, it is not essential that each of the cavity forming regions 98 of the double blister pack of FIGS. 7 and 8 should have the shape and configuration illustrated. Thus, the unbonded region 92 need not be provided, the pill simply being received in a suitably shaped cavity which is larger in at least one plan dimension than, the corresponding dimension of the pill.

I claim:

1. A unit portion, child-resistant, pack for pills or like solid product items, the pack being formed of first and second webs defining therebetween a plurality of mutually spaced cavity-forming regions around the periphery of each of which the webs are bonded together at peripheral regions thereof, and a plurality of the said pills or like solid product items which are received in the cavity-forming regions individually and which are substantially smaller in at least one plan dimension than the corresponding plan dimension of the cavity-forming region, at least one of the webs being flexible whereby the product items may be manipulated from outside the pack and through the pack material to undergo movement within the cavity-forming regions at least in the direction of the said plan dimension, at least the first web being a laminate comprising a rupturable layer and a tear resistant layer which is formed with score or slit lines adapted to provide dispensing openings for the product items, the peripheral regions being rendered tear resistant by at least one of said webs, the score or slit lines crossing the cavity-forming regions at a spacing from, and inboard of the peripheries of said cavity-forming regions but being located or locatable by said movement of the product items within the cavity-forming regions to lie on or outboard of the peripheries of the product items, whereby the product items may individually act as tools to enable the first web to be ruptured along the respective score or slit line by finger pressure.

2. A unit portion pack according to claim 1, wherein each cavity-forming region and the product item received therein are shaped and dimensionsed such that a vacant area substantially triangular in cross section can be defined at the periphery of the cavity-forming region, said vacant area being defined by spaced facing surfaces of said first and second webs and the periphery of said solid product item, and wherein the score or slit line is arranged to cross said area.

3. A unit portion pack according to claim 1, wherein one or both of said webs have been thermoformed or cold formed to have a plurality of regularly shaped recesses therein which form product item receiving cavities of said cavity-forming regions.

4. A unit portion pack according the claim 1, in which said first and second webs are of the same laminate material.

5. A unit portion pack according to claim 1 or claim 4, in which the rupturable layer is of metal foil.

6. A unit portion pack according to claim 1 or claim 4, in which the metal foil is aluminum foil.

7. A unit portion according to claim 1 or claim 4, in which the rupturable layer is of paper.

8. A unit portion pack according to claim 1 or claim 4, in which the rupturable layer is of tearable plastics material film.

9. A unit portion pack according to claim 1 or claim 4, in which the tearable film is 25μ uniaxially oriented low density polyethylene film.

10. A unit portion pack according to claim 1 or claim 4, in which said tear resistant layer is of plastics material film.

11. A unit portion pack according to claim 1 or claim 4, in which said plastics material film is polyester film.

12. A unit portion pack according to claim 1 or claim 4, in which said plastics material film is nylon film.

13. A unit portion pack according to claim 1 or claim 4, in which said plastics material film is PVC film.

14. A unit portion pack according to claim 1, in which the rupturable layer of the first web is on the inside of each cavity-forming region.

15. A unit portion pack according to claim 1, in which the first and second webs are heat sealed together by way of longitudinally extending and transversely extending heat seals defining one or more longitudinally aligned rows of the cavity-forming regions, the height of each cavity being the same as that of the product item contained having been extended by the product item, and wherein a respective score or slit line extends longitudinally of the pack across all the regions of one row being located adjacent to, but spaced inwardly of, a respective said longitudinally extending heat seal.

16. A unit portion pack according to claim 1, in which both said first and second webs have been formed from laminate to have a plurality of regularly spaced recesses therein, the recesses of the two webs being aligned and the two webs being bonded together around the recesses to define a plurality of cavity-forming regions, each cavity-forming region comprising a product item containing central cavity surrounded by a peripheral unbonded region at which the webs are closely adjacent one another, and wherein a score or slit line extends across each said cavity-forming region at the unbonded region thereof.

17. A unit portion child-resistant, pack for pills or like solid product items, the pack comprising a first web of laminated material, the laminated material having a first layer of rupturable material and a second layer of tear resistant material, one or more score or slit lines being formed in said second layer of said first web, and a second web of material, longitudinally and transversely extending strip-shaped regions of said first web being bonded to corresponding longitudinally and transversely extending strip-shaped regions of said second web to define a plurality of spaced cavity-forming regions between said first and second webs, each cavity-forming region having a periphery defined by said bonded strip-shaped regions such that each said cavity-forming region is sealed, closed and substantially surrounded by tear resistant material, one of said score or slit lines extending across each said cavity-forming region at a spacing from its periphery, the pack further comprising a plurality of pills or like solid product items, each individual product item being received within a respective cavity-forming region, the transverse dimension of each product item being less than the transverse dimension of the respective cavity-forming region in which the product item is disposed such that the product item is movable within the cavity-forming region along its transverse dimension, at least one of said first and second webs being flexible to enable manipulation of each said product item to move it within said cavity-forming region, and wherein the score or slit line extending across each said cavity-forming region is adapted to form a dispensing opening for the product item, said score or slit line extending along the longitudinal dimension of said cavity-forming region and being locatable, by movement of said product item along the transverse dimenson, on the periphery or externally of the product item.

* * * * *